US008850922B2

(12) United States Patent
Gray

(10) Patent No.: US 8,850,922 B2
(45) Date of Patent: Oct. 7, 2014

(54) PNEUMATIC ACCELERATOR PEDAL ACTUATOR

(75) Inventor: Michael David Gray, Milford, MI (US)

(73) Assignee: GM Global Technology Operations LLC

( * ) Notice: Subject to any disclaimer, the term of this patent is extended or adjusted under 35 U.S.C. 154(b) by 781 days.

(21) Appl. No.: 11/748,081

(22) Filed: May 14, 2007

(65) Prior Publication Data

US 2008/0229870 A1 Sep. 25, 2008

Related U.S. Application Data

(60) Provisional application No. 60/919,954, filed on Mar. 23, 2007.

(51) Int. Cl.
*G05G 1/30* (2008.04)
*G05G 1/54* (2008.04)
*G05G 5/00* (2006.01)

(52) U.S. Cl.
CPC ..... *G05G 5/005* (2013.01); *G05G 1/54* (2013.01); *G05G 1/30* (2013.01)
USPC ..... 74/512; 74/513; 477/200

(58) Field of Classification Search
CPC ..... G05G 1/34; G05G 1/305; G05G 1/30; G05G 1/54; G05G 5/005
USPC ..... 74/512–514, 560–561.5, 481, 482; 73/114.36, 128, 132, 862.543; 701/70; 267/64.25, 123, 170, 174–180; 303/3, 303/4, 132, 127, 33, 38, 40, 45, 57, 71, 82; 477/200, 201, 210, 218, 192
See application file for complete search history.

(56) References Cited

U.S. PATENT DOCUMENTS

| | | | | | |
|---|---|---|---|---|---|
| 1,942,368 | A | * | 1/1934 | Wilkoff | 73/132 |
| 2,566,859 | A | * | 9/1951 | Seeler | 74/513 |
| 3,465,577 | A | * | 9/1969 | Donovan | 73/118.01 |
| 3,662,593 | A | * | 5/1972 | Pirrello et al. | 73/132 |
| 3,713,332 | A | | 1/1973 | Herrbrich | |
| 3,788,131 | A | * | 1/1974 | Markey | 73/132 |
| 3,877,299 | A | * | 4/1975 | Clayton et al. | 73/132 |
| 3,977,241 | A | * | 8/1976 | Asmus et al. | 73/132 |
| 3,991,609 | A | * | 11/1976 | Asmus et al. | 73/132 |
| 4,546,667 | A | * | 10/1985 | Bopst, III | 74/526 |
| 4,621,525 | A | * | 11/1986 | King et al. | 73/118.01 |
| 4,635,767 | A | * | 1/1987 | Crane | 477/192 |
| 2005/0057087 | A1 | * | 3/2005 | Ahnafield | 303/20 |

FOREIGN PATENT DOCUMENTS

| | | | |
|---|---|---|---|
| DE | 2004979 | A1 | 8/1971 |
| DE | 9305797 | U1 | 6/1993 |
| DE | 4241805 | A1 | 6/1994 |
| DE | 19923697 | A1 | 11/2000 |
| DE | 19952228 | A1 | 5/2001 |
| EP | 1096355 | A2 | 5/2001 |

* cited by examiner

*Primary Examiner* — Daniel Yabut

(57) ABSTRACT

A vehicle accelerator pedal actuator may include a pressurized fluid source, a mounting mechanism configured to fix the accelerator pedal actuator relative to a vehicle accelerator pedal, and an actuating mechanism in fluid communication with the pressurized fluid source and configured to displace the vehicle accelerator pedal. The vehicle accelerator pedal actuator may further include a valve member selectively controlling fluid communication between the pressurized fluid source and the actuating mechanism.

9 Claims, 4 Drawing Sheets

PNEUMATIC ACCELERATOR PEDAL ACTUATOR

CROSS-REFERENCE TO RELATED APPLICATIONS

This application claims the benefit of U.S. Provisional Application No. 60/919,954, filed on Mar. 23, 2007. The disclosure of the above application is incorporated herein by reference.

FIELD

The present disclosure relates to actuation mechanisms, and more specifically to actuation mechanisms for vehicle validation.

BACKGROUND

The statements in this section merely provide background information related to the present disclosure and may not constitute prior art.

Electronic throttle control (ETC) systems may replace the mechanical pedal assemblies that have been used in vehicles. ETC systems enhance overall engine management while reducing the cost of the vehicle. Traditional engine controls rely on direct input from drivers and numerous valves and linkages to manage the engine.

ETC sensors and remote throttle actuators may eliminate the linkage that is used to connect the accelerator pedal to the throttle body. ETC sensors take input from the driver's foot through a determined accelerator pedal position and send it to an engine control system in real time. The engine control system modulates the air/fuel flow to the engine. Direct control of the engine is shifted from the driver to the engine control system to improve efficiency.

Due to the elimination of the traditional linkages in ETC systems, throttle position is evaluated based on accelerator pedal position during vehicle validation. Accuracy and repeatability of accelerator position provides for proper evaluation of ETC system accuracy.

SUMMARY

Accordingly, a vehicle accelerator pedal actuator may include a pressurized fluid source, a mounting mechanism configured to fix the accelerator pedal actuator relative to a vehicle accelerator pedal, and an actuating mechanism in fluid communication with the pressurized fluid source and configured to displace the vehicle accelerator pedal. The vehicle accelerator pedal actuator may further include a valve providing selective communication between the pressurized fluid source and the actuating mechanism.

A method of actuating a vehicle accelerator pedal may include locating a vehicle accelerator pedal actuator proximate the vehicle accelerator pedal, securing the vehicle accelerator pedal actuator relative to the vehicle accelerator pedal, and providing a source of pressurized fluid to the vehicle accelerator pedal actuator to displace the vehicle accelerator pedal.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
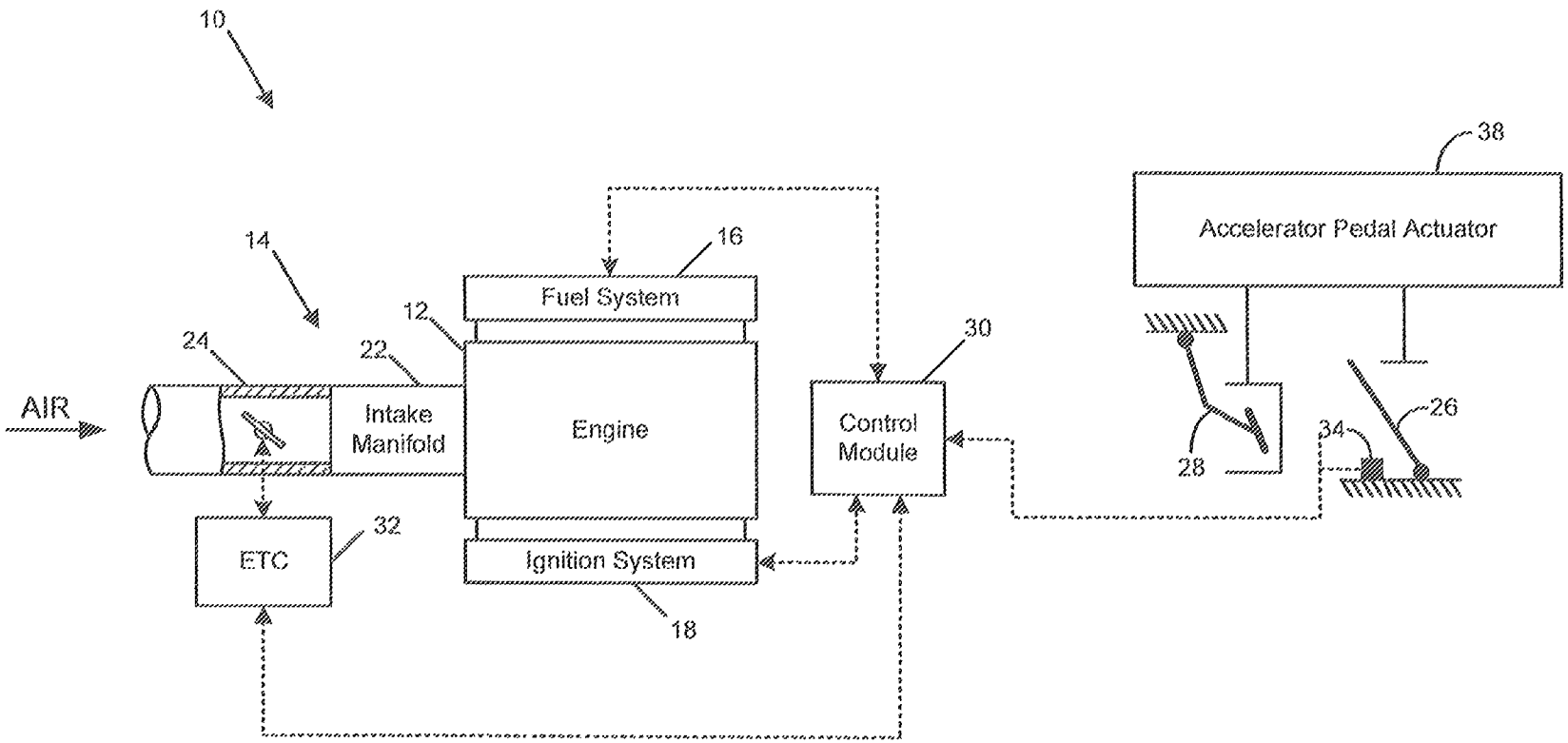
FIG. 1 is a schematic illustration of a vehicle and an accelerator pedal actuator according to the present disclosure.

The following description is merely exemplary in nature and is not intended to limit the present disclosure, application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, or other suitable components that provide the described functionality.

Referring now to FIG. 1, an exemplary vehicle 10 is schematically illustrated. Vehicle 10 may include an engine 12 in communication with an intake system 14, a fuel system 16, and an ignition system 18. Intake system 14 may include an intake manifold 22 and a throttle 24. Throttle 24 may control an air flow into engine 12. Fuel system 16 may control a fuel flow into engine 12 and ignition system 18 may ignite the air/fuel mixture provided to engine 12 by intake system 14 and fuel system 16.

Vehicle 10 may further include an accelerator pedal 26, a brake pedal 28, a control module 30, and an electronic throttle control (ETC) 32. Accelerator pedal 26 may be in communication with an accelerator pedal sensor 34. Accelerator pedal sensor 34 may be in communication with control module 30 and provide a signal indicative of accelerator pedal position.

Control module 30 may be in communication with ETC 32 and provide a signal indicative of the position of accelerator pedal 26. ETC 32 may be in communication with throttle 24 and may control operation thereof based on the accelerator pedal position. During validation of vehicle 10, an accelerator pedal actuator 38 may be fixed to vehicle 10 relative to accelerator pedal 26. More specifically, accelerator pedal actuator 38 may be fixed to brake pedal 28, as discussed below.

Figure 2:
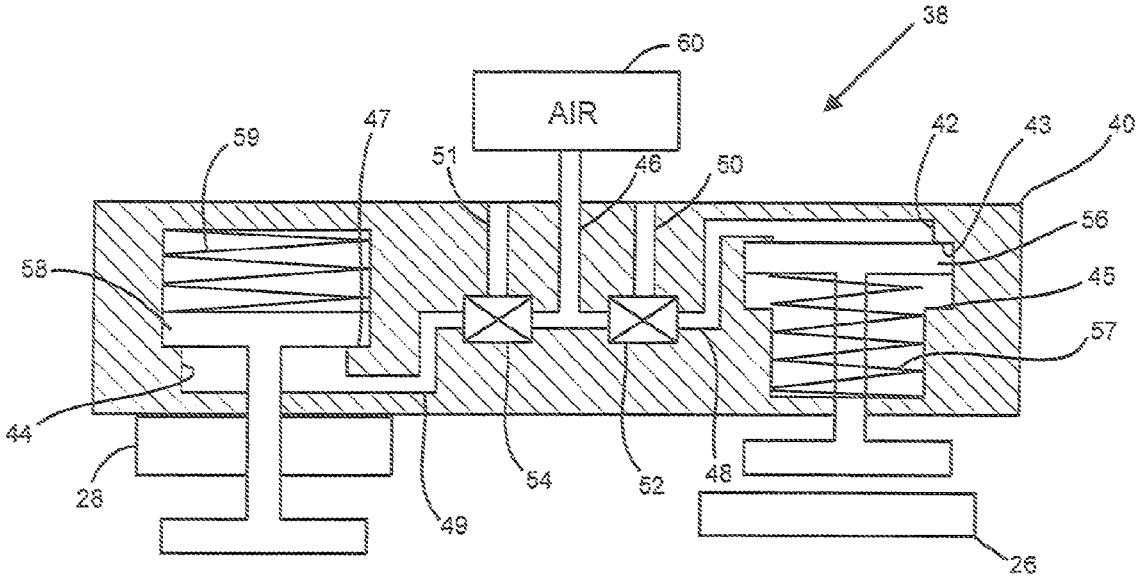
FIG. 2 is a schematic illustration of the accelerator pedal actuator of FIG. 1 in a first orientation.
Figure 3:
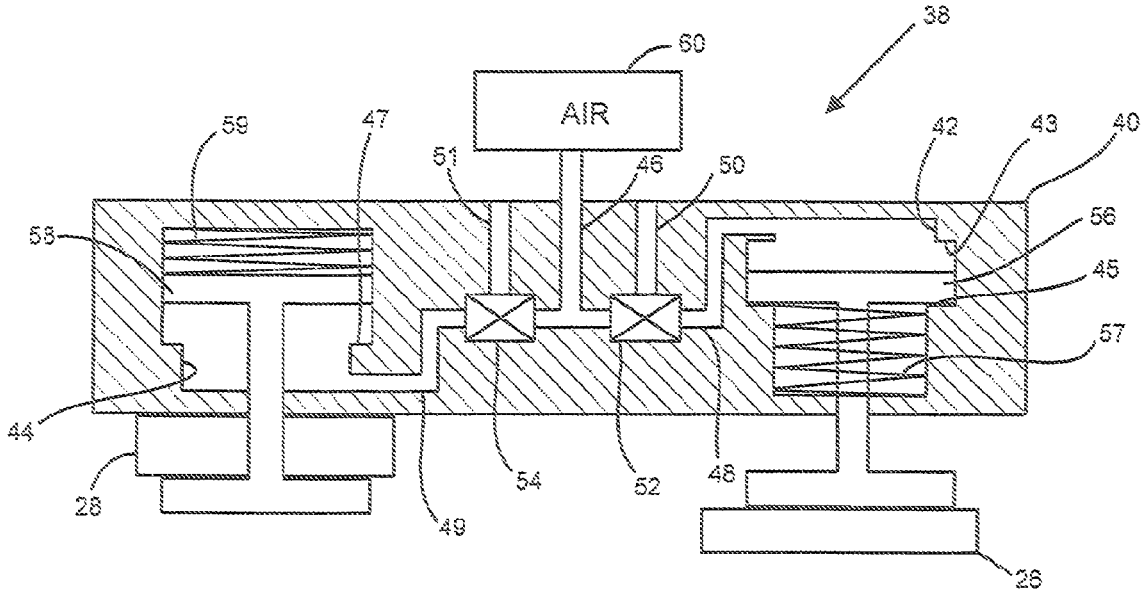
FIG. 3 is a schematic illustration of the accelerator pedal actuator of FIG. 1 in a second orientation.

With additional reference to FIGS. 2 and 3, accelerator pedal actuator 38 may include a main body structure 40 having first and second chambers 42, 44 formed therein. First chamber 42 may include first and second stops 43, 45 therein. Second chamber 44 may include a stop 47 therein as well. A first fluid passage 46 may extend within main body structure 40. Second, third, fourth, and fifth fluid passages 48, 49, 50, 51 may branch off from first fluid passage 46. Second fluid passage 48 may be in fluid communication with first chamber 42 and third fluid passage 49 may be in fluid communication with second chamber 44. Second and third fluid passages 48, 49 may provide fluid communication between first fluid passage 46 and first and second chambers 42, 44.

A first valve member 52 may be disposed in second fluid passage 48 and a second valve member 54 may be disposed in third fluid passage 49. Fourth and fifth fluid passages 50, 51 may be in communication with first and second valve members 52, 54 and the atmosphere. First and second valve members 52, 54 may selectively allow or block fluid communication between first fluid passage 46 and first and second chambers 42, 44. First and second valve members 52, 54 may also selectively provide fluid communication between fourth and fifth fluid passages 50, 51 and first and second chambers 42, 44.

First and second valve members 52, 54 may be activated independently from one another. First and second valve members 52, 54 may be manually actuated or may be actuated automatically, such as through the use of a solenoid valve. First and second chambers 42, 44 may be vented to atmosphere when fourth and fifth fluid passages 50, 51 are placed in communication with second and third fluid passages 48, 49, respectively.

First and second actuating members 56, 58 may be slidably disposed within first and second chambers 42, 44 and may be normally biased into disengaged positions (as seen in FIG. 2) by springs 57, 59. More specifically, spring 57 may generally bias first actuating member 56 against first stop 43. Spring 59 may generally bias second actuating member 58 against stop 47. First actuating member 56 may form an accelerator pedal actuating mechanism and second actuating member 58 may form a mounting mechanism for accelerator pedal actuator 38. With reference to FIG. 3, first actuating member 56 may displace accelerator pedal 26 a predetermined distance, as discussed below. Second actuating member 58 may clamp brake pedal 28 to main body structure 40, as discussed below.

A fluid supply 60 may be in communication with first passage 46. Fluid supply 60 may provide a pressurized fluid to first fluid passage 46. More specifically, fluid supply 60 may include a pressurized air supply. Pressurized air from fluid supply 60 may be used to displace first actuating member 56 for displacement of accelerator pedal 26. Pressurized air from fluid supply 60 may also be used to displace second actuating member 58 for mounting accelerator pedal actuator 38 to brake pedal 28.

Figure 4:
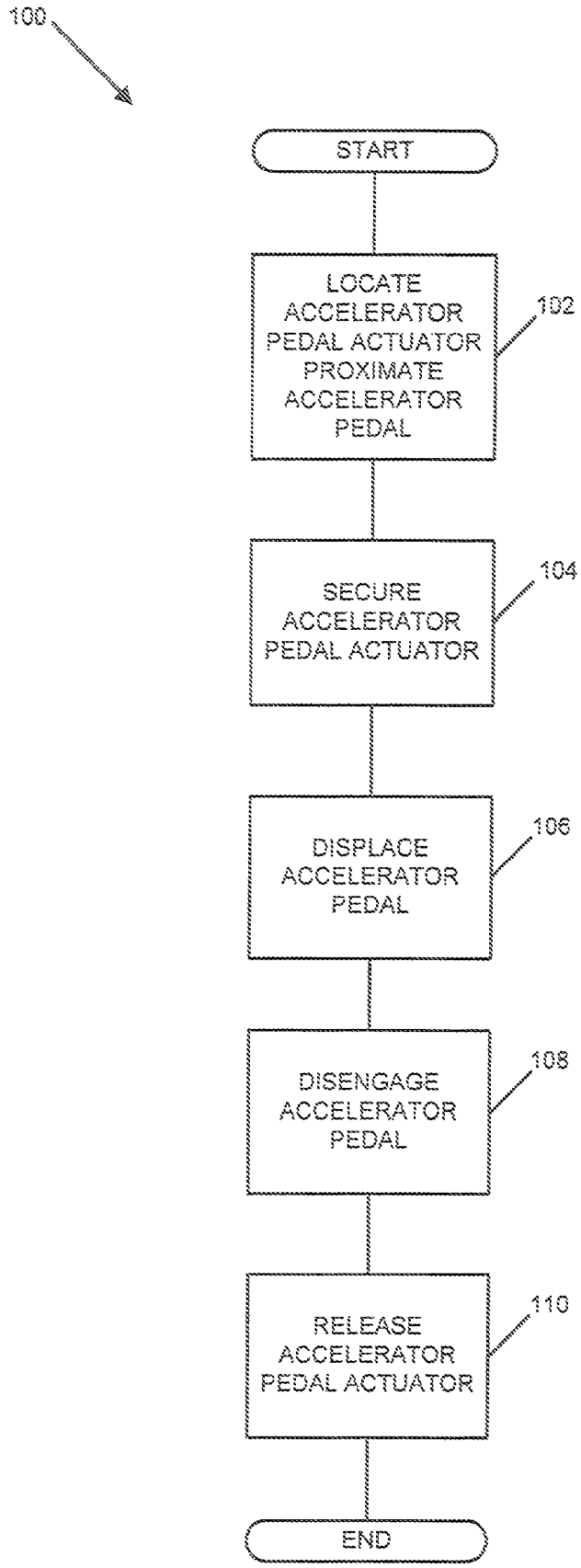
FIG. 4 is a flow chart illustrating operation of the accelerator pedal actuator of FIGS. 1-3.

With additional reference to FIG. 4, flow chart 100 generally shows operation of accelerator pedal actuator 38. As indicated at step 102, accelerator pedal actuator 38 may be located proximate to accelerator pedal 26. More specifically, locating accelerator pedal actuator 38 may include positioning accelerator pedal actuator 38 such that first actuating member 56 is located above accelerator pedal 26 and may include first actuating member 56 being in a spaced relation to accelerator pedal 26. As indicated at step 104, accelerator pedal actuator 38 may then be secured in position.

Securing accelerator pedal actuator 38 may include fixing accelerator pedal actuator 38 at a location relative to accelerator pedal 26. Securing may include fixing accelerator pedal actuator 38 to a vehicle structure such as brake pedal 28 (as seen in FIG. 3). Pneumatic pressure may be supplied to second chamber 44 by fluid supply 60 and may be applied to second actuating member 58 by opening second valve member 54 to a first position providing fluid communication between first and third fluid passages 46, 49. The pneumatic pressure may force second actuating member 58 axially inwardly against the biasing force applied by spring 59 to clamp brake pedal 28 against main body structure 40 of accelerator pedal actuator 38.

As indicated at step 106, accelerator pedal 26 may then be displaced a predetermined distance. The predetermined distance for displacement of first actuating member 56 may be provided by the stroke of first actuating member 56. The stroke of first actuating member 56 may generally be defined by first and second stops 43, 45. Alternatively, the stroke of first actuating member 56 may be defined by using stops or other displacement limiting devices outside of main body structure 40.

In the disengaged position (seen in FIG. 2), first actuating member 56 may abut first stop 43 and may be in a first position relative to accelerator pedal 26. More specifically, first actuating member 56 may generally be in a spaced relation relative to accelerator pedal 26. The initial position of accelerator pedal 26 relative to brake pedal 28 may be known and may therefore provide a reference for displacement of accelerator pedal 26 since accelerator pedal actuator 38 is mounted to brake pedal 28 and first actuating member 56 is displaced relative thereto. Alternatively, first actuating member 56 may be placed in contact with accelerator pedal 26 when first actuating member 56 abuts first stop 43 while accelerator pedal 26 is at its fully returned position.

Once first actuating member 56 is displaced by a distance generally equal to the spaced relation from accelerator pedal 26, accelerator pedal 26 may be displaced therewith. Therefore, the displacement of accelerator pedal 26 may generally be defined as the stroke of first actuating member 56 less the initial spaced relation between first actuating member 56 and accelerator pedal 26. More specifically, accelerator pedal 26 may be displaced by pneumatic pressure supplied to first chamber 42 and applied to first actuating member 56 by opening first valve member 52 to a first position providing fluid communication between first and second fluid passages 46, 48. The pneumatic pressure may force first actuating member 56 axially outwardly against the biasing force of spring 57 to displace accelerator pedal 26. First actuating member 56 may be displaced axially outwardly until first actuating member 56 engages second stop 45.

As indicated at step 108, accelerator pedal actuator 38 may then disengage accelerator pedal 26. Accelerator pedal actuator 38 may release accelerator pedal 26 by venting first chamber 42. First chamber 42 may be vented by opening first valve member 52 to a second position. In the second position, first valve member 52 may provide fluid communication between second and fourth fluid passages 48, 50, venting first chamber 42 to the atmosphere. Spring 57 may then bias first actuating member 56 back to the disengaged position (seen in FIG. 2).

As indicated at step 110, accelerator pedal actuator 38 may then be released from engagement with vehicle 10. Accelerator pedal actuator 38 may be removed from brake pedal 28 by venting second chamber 44. Second chamber 44 may be vented by opening second valve member 54 to a second position. In the second position, second valve member 54 may provide fluid communication between third and fifth fluid passages 49, 51, venting second chamber 44 to the atmosphere. Spring 59 may then bias second actuating member 58 back to the disengaged position (seen in FIG. 2). Accelerator pedal actuator 38 may then be removed from brake pedal 28.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, the specification and the following claims.

What is claimed is:

1. A vehicle accelerator pedal actuator, comprising:

a body;

a first chamber formed within the body;

a first actuating member having a first portion located within the first chamber and a second portion located outside of the first chamber and the body;

a first biasing member located within the first chamber, the first biasing member configured to bias the first actuating member to a first position within the first chamber, wherein, in the first position, the second portion of the first actuating member is configured to unclamp a brake pedal from the body;

a second chamber formed within the body;

a second actuating member having a first portion located within the second chamber and a second portion located outside of the second chamber and the body;

a second biasing member located within the second chamber, the second biasing member configured to bias the second actuating member to a second position within the first chamber, wherein, in the second position, the second portion of the second actuating member is configured to release an accelerator pedal;

a pressurized fluid source;

a first valve configured to selectively provide fluid, pressurized from the fluid source, against the first portion of the first actuating member to force the first portion of the first actuating member to a third position within the first chamber, and against the first biasing member, to cause the second portion of the first actuating member to clamp the brake pedal to the body; and a second valve configured to selectively provide the fluid against the first portion of the second actuating member to force the first portion of the second actuating member to a fourth position within the second chamber, and against the first biasing member, to cause the second portion of the second actuating member to depress the accelerator pedal.

2. The vehicle accelerator pedal actuator of claim 1, wherein:

the second chamber includes a first stop and a second stop formed within the second chamber;

the first stop is arranged to stop the second actuating member in the second position;

the second stop is arranged to stop the actuating member in the fourth position such that the fourth position corresponds to a predetermined depressed position of the accelerator pedal relative to the brake pedal.

3. The vehicle accelerator pedal actuator of claim 2, wherein a displacement range of the second actuating member is defined by the first stop and the second stop.

4. The vehicle accelerator pedal actuator of claim 2, wherein:

the first chamber includes a third stop formed within the first chamber;

the third stop is arranged to stop the first actuation member in the first position.

5. The vehicle accelerator pedal actuator of claim 2, further comprising:

a first fluid passage formed within the body between the pressurized fluid source and each of the first valve and the second valve;

a second fluid passage formed within the body between the first valve and the first chamber, wherein the first valve is arranged to selectively allow fluid communication between the pressurized fluid source and the first chamber via the first fluid passage and the second fluid passage; and a third fluid passage formed within the body between the second valve and the second chamber, wherein the second valve is arranged to selectively allow fluid communication between the pressurized fluid source and the second chamber via the first fluid passage and the third fluid passage.

6. The vehicle accelerator pedal actuator of claim 5, further comprising:

a fourth fluid passage formed within the body between the first valve and atmosphere, wherein the first valve is arranged to selectively vent the first chamber to the atmosphere via the second fluid passage and the fourth fluid passage; and a fifth fluid passage formed within the body between the second valve and the atmosphere, wherein the second valve is arranged to selectively vent the second chamber to the atmosphere via the third fluid passage and the fifth fluid passage.

7. The vehicle accelerator pedal actuator of claim 1, wherein the pressurized fluid source corresponds to a pressurized air supply.

8. The vehicle accelerator pedal actuator of claim 1, wherein:

selectively providing the fluid, with the first valve, against the first portion of the first actuating member forces the first actuating member in a first direction to the third position within the chamber; and selectively providing the fluid, with the second valve, against the first portion of the second actuating member forces the second actuating member in a second direction to the fourth position within the chamber, wherein the second direction is opposite the first direction.

9. The vehicle accelerator pedal actuator of claim 8, wherein:

biasing the first actuating member, with the first biasing member, to the first position within the first chamber forces the first actuating member in the second direction to unclamp the brake pedal from the body; and biasing the second actuating member, with the second biasing member, to the second position within the first chamber forces the second actuating member in the first direction to release the accelerator pedal.

* * * * *